US010410809B2

(12) United States Patent
Fangmann

(10) Patent No.: US 10,410,809 B2
(45) Date of Patent: Sep. 10, 2019

(54) ELECTRIC SWITCH

(71) Applicant: JOHNSON ELECTRIC INTERNATIONAL AG, Murten (CH)

(72) Inventor: Gerhard Fangmann, Marienheide (DE)

(73) Assignee: JOHNSON ELECTRIC INTERNATIONAL AG, Murten (CH)

( * ) Notice: Subject to any disclaimer, the term of this patent is extended or adjusted under 35 U.S.C. 154(b) by 0 days.

(21) Appl. No.: 15/711,564

(22) Filed: Sep. 21, 2017

(65) Prior Publication Data

US 2018/0082804 A1 Mar. 22, 2018

(30) Foreign Application Priority Data

Sep. 21, 2016 (DE) ..... 10 2016 117 786

(51) Int. Cl.
*H01H 19/20* (2006.01)
*H01H 15/10* (2006.01)
(Continued)

(52) U.S. Cl.
CPC ..... *H01H 15/10* (2013.01); *H01C 10/38* (2013.01); *H01C 10/44* (2013.01); *H01H 9/061* (2013.01); *H01H 15/04* (2013.01); *H01H 9/04* (2013.01); *H01H 9/063* (2013.01); *H01H 2201/004* (2013.01); *H01H 2205/002* (2013.01); *H01H 2223/002* (2013.01); *H01H 2231/048* (2013.01); *H01H 2235/01* (2013.01); *H01H 2239/01* (2013.01); *H01H 2239/014* (2013.01)

(58) Field of Classification Search
CPC ..... H01H 19/20; H01H 19/11; H01H 19/115; H01H 19/585; H01H 19/36; H01H 19/38; H01H 19/40; H01H 9/063; H01H 2009/066; H01H 13/08; H01H 15/005; H01H 15/04; H01H 15/06; H01C 10/38; H01C 10/44
See application file for complete search history.

(56) References Cited

U.S. PATENT DOCUMENTS 4,861,951 A * 8/1989 Olson ..... H01H 1/403 200/11 DA
5,453,728 A * 9/1995 Zimmermann ..... H01C 10/30 338/173

(Continued)

FOREIGN PATENT DOCUMENTS

WO WO 2017032564 A1 * 3/2017 ..... H01H 9/04

*Primary Examiner* — Felix O Figueroa
(74) *Attorney, Agent, or Firm* — Muncy, Geissler, Olds & Lowe, P.C.

(57) ABSTRACT

An electric switch for electrical devices that includes a circuit board immovably arranged in a switch housing, the circuit board includes on one of its surfaces the contact paths of a contact system as well as contact surfaces in the form of potentiometer tracks. The contact paths interact with sliding contacts of the contact system and the potentiometer tracks interact with additional sliding contacts in order to set the revolutions per minute or the torque of the electric motor, movement of the plunger causes the sliding contacts of the contact system to come into contact with the associated contact paths, and, in this position of the plunger, which is the on position of the switch, the sliding contacts used for changing the direction of rotation are in the same way already in contact with the associated potentiometer tracks on the circuit board.

19 Claims, 3 Drawing Sheets

(51) Int. Cl.

| | |
|---|---|
| ***H01C 10/44*** | (2006.01) |
| ***H01C 10/38*** | (2006.01) |
| ***H01H 15/04*** | (2006.01) |
| ***H01H 9/06*** | (2006.01) |
| *H01H 9/04* | (2006.01) |

(56) References Cited

U.S. PATENT DOCUMENTS

| | | | | |
|---|---|---|---|---|
| 6,104,105 | A * | 8/2000 | Schaeffeler | H01H 9/061 200/522 |
| 8,410,387 | B2 * | 4/2013 | Niklewski | H01H 9/061 200/522 |
| 8,550,181 | B2 * | 10/2013 | Kobayashi | H01H 13/06 173/217 |
| 8,981,244 | B2 * | 3/2015 | Ho | B25F 5/00 200/11 J |
| 2016/0189886 | A1 * | 6/2016 | Terasawa | H01H 1/06 200/252 |

* cited by examiner

ELECTRIC SWITCH

CROSS REFERENCE TO RELATED APPLICATIONS

This non-provisional patent application claims priority under 35 U.S.C. § 119(a) from Patent Application No. 10 2016 117 786.5 filed in Germany on Sep. 21, 2016.

FIELD OF THE INVENTION

The present invention relates to an electric switch, in particular to one used for manually operated power tools having an electric motor

BACKGROUND OF THE INVENTION

In general, electric switches of this type for manually operated power tools and appliances, such as electric drills, cordless screwdrivers, hammer drills or the like, include, an electric circuit which can be switched by an activation element that is activated from outside, control and regulation of the rotational speed or torque of the motor. In general, rotary or slide potentiometers are used for this purpose. The use of a mechanical changeover device in addition to this rotational speed control is also known. This requires a high number of contact systems, which leads to a complex structure of the switch.

SUMMARY OF THE INVENTION

Accordingly, there is a desire for an improved electric switch.

The electric switch is particularly for use in manually operated power tools having an electric motor. A switch of this kind includes a switch housing. Protruding from this housing is a plunger for manually operating the electric device, said plunger being connected to an actuation element. Actuating the actuation element causes the plunger to move, namely from an initial position where the electric device is switched off, to an on position, where the electric device is operating. Movement of the plunger switches at least one contact of the contact system arranged within the switch housing. This contact system includes both sliding contacts, which are movable by way of a slider arranged on the plunger, as well as contact paths, which are provided on a circuit board that is immovably arranged in the switch housing. In addition to the contact paths for the contact system, the circuit board furthermore features contact pads in the form of potentiometer tracks which interact with additional sliding contacts. Said sliding contacts are likewise movable by way of a slider arranged on the plunger. The rotational speed or the torque of the electric motor is adjustable through interaction of the sliding contacts with the potentiometer tracks. The contact paths for the contact system and the potentiometer tracks are located on the same surface of the circuit board. In the on position of the switch, the sliding contacts of the contact system contact the paths on the circuit board, and, in the same way, contact the sliding contacts used for changing rotational speed by way of the potentiometer tracks. In the off position of the switch, the sliding contacts of the contact system do not make contact with the contact paths. They are located, for example, in front of the contact paths on insulating pads on the upper surface of the circuit board.

Given that movement of the plunger results in movement of the sliding contacts for changing rotational speed as well as movement of the sliding contacts for the contact system, the contact path and the potentiometer track are preferentially arranged on the same surface of the circuit board and in the same orientation. In a preferential embodiment, the sliding contacts are located on the front end of the circuit board in the off position. When the device is switched on, the movement of the plunger pulls the sliding contacts away from the front end. Preferably provided on the plunger and within the switch housing is a restoring spring, the force of which automatically moves the plunger back in the direction of the off position.

In an embodiment, the movement of the plunger (hence also that of the slider attached thereto) is a linear movement, namely in a plane parallel to the circuit board. However, a rotational movement is also possible if the contact paths and the potentiometer tracks are correspondingly arranged in circular fashion on the circuit board.

In regard to electric devices in which it is also desirable to set the direction of rotation in addition to controlling rotational speed, a further embodiment of the electric switch includes a changeover device for changing the direction of rotation of the electric motor, for example from clockwise to counterclockwise. Corresponding conducting paths can be provided on the circuit board for this purpose. In this case, the changeover device interacts with the conducting paths arranged on the other surface of the circuit board, for example the lower surface, whereas the potentiometer track and the contact paths for the contact system are arranged on the upper surface of the circuit board.

Movement of the plunger thus causes movement of the sliding contacts of the contact system from the on position to the off position or vice versa; only a short adjustment travel path is provided for this purpose. At the same time, the movement of the plunger also causes a change in rotational speed and torque because the sliding contacts provided on the slider of the plunger interact with the potentiometer tracks. Changing the adjustment travel path of these sliding contacts along the potentiometer tracks changes the resistance, which is regulated, for example, by the rotational speed of the electric motor. By this further displacement of the plunger and by extending the displacement path, the sliding contacts of the contact system furthermore contact the associated contact paths, which also include a corresponding extension for this purpose. As a consequence, the plunger simultaneously creates a contact for switching the electric motor on and adjusts the rotational speed thereof Given that both surfaces of the circuit board are available for the various functions of the switch, and that the circuit board is immovably arranged in the housing, the novel electric switch described above is designed to be quite compact. This also simplifies the sealing of an electric switch of this type. Contacts in the novel electric switch are simplified. Soldered and clamping connections are omitted from the contact system, thus leading to easier assembly and lower manufacturing costs. Furthermore, the novel electric switch can be built to be low in height.

DETAILED DESCRIPTION OF THE PREFERRED EMBODIMENTS

The technical solutions of the embodiments of the present invention will be clearly and completely described as follows with reference to the accompanying drawings. Apparently, the embodiments as described below are merely part of, rather than all, embodiments of the present invention. Based on the embodiments of the present invention, any other embodiment obtained by a person skilled in the art without paying any creative effort shall fall within the protection scope of the present invention.

It is noted that, when a component is described to be "fixed" to another component, it can be directly fixed to the another component or there may be an intermediate component. When a component is described to be "connected" to another component, it can be directly connected to the another component or there may be an intermediate component. When a component is described to be "disposed" on another component, it can be directly disposed on the another component or there may be an intermediate component.

Unless otherwise specified, all technical and scientific terms have the ordinary meaning as commonly understood by people skilled in the art. The terms used in this disclosure are illustrative rather than limiting. The term "and/or" used in this disclosure means that each and every combination of one or more associated items listed are included.

Figure 1:
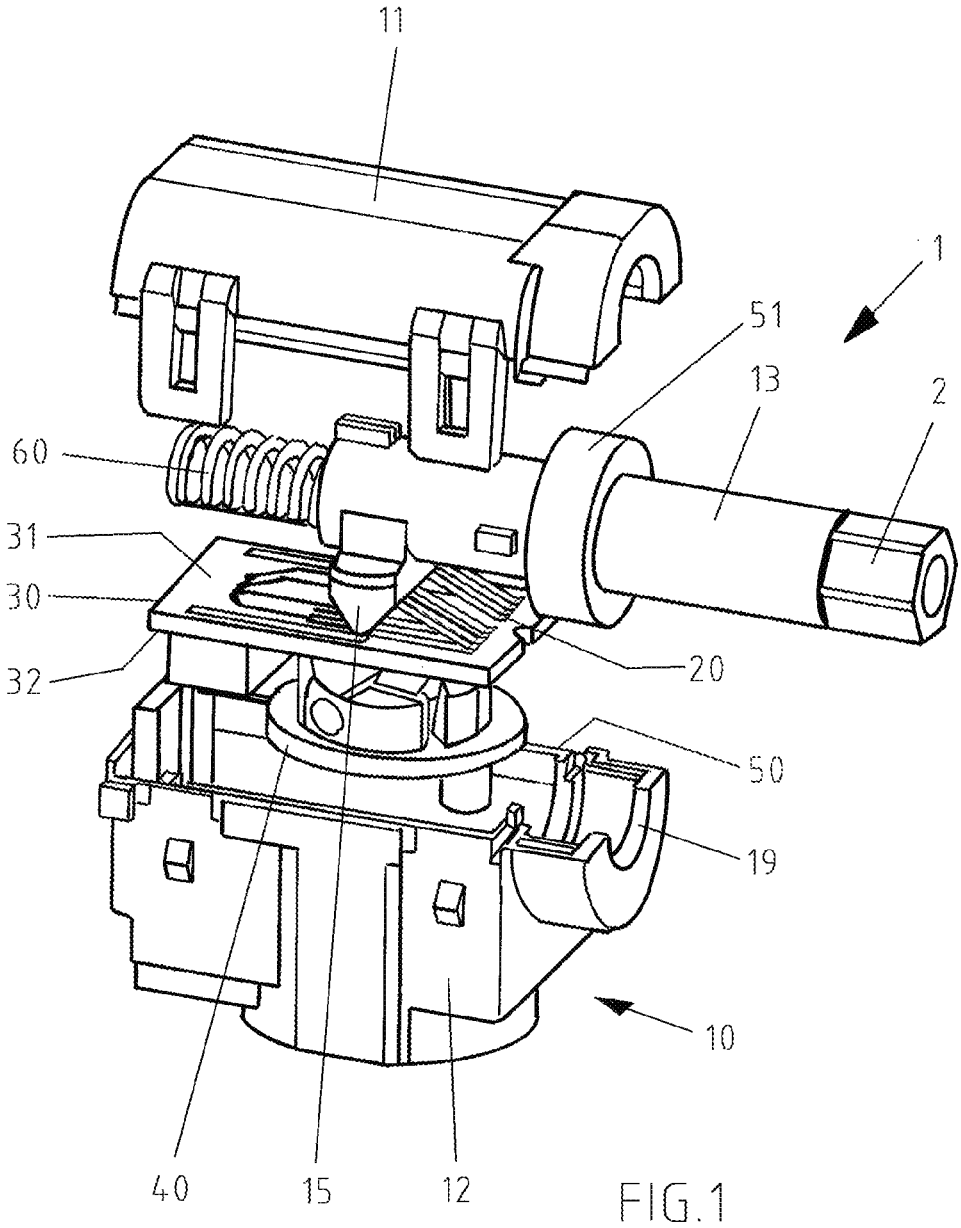
FIG. 1 is a perspective view of an electric switch according to one embodiment of the present invention.

FIG. 1 illustrates an electric switch 1 in accordance with one embodiment of the present invention. The electric switch 1 may be used for manually operated power tools and appliances having an electric motor, for example electric drills, cordless screwdrivers, hammer drills and the like. For this purpose, this electric switch 1 is incorporated into a switch housing of the power tool and a plunger 13 of the electric switch 1 is connected to, for example, a manually actuable actuation member via a connection 2. An electrical cable (not shown) extends from the electric switch 1 and is connected to the electric motor of the device. In at least one embodiment, the switch 1 shown comprises an adjustable changeover device 40 for setting the direction of rotation of the electric motor. The changeover device 40 interacts with, for example, a corresponding shift lever in a power tool, the shift lever being adjustable from the outside. In other embodiments, the power tools who do not require the provision of different directions of electric motor rotation, the changeover device 40 that is accessible from the outside may be omitted.

The switch housing 10 of the electric switch 1 shown in FIG. 1 comprises two shells, namely an upper shell 11 and a lower shell 12. Provided between the shells 11, 12 is a one-piece circumferential seal 50, which is arranged on the edges of the shells 11, 12 and comprises a circumferential sealing ring 51 in the area of an opening 19. The opening 19 is formed by both of the shells 11 and 12 and is provided for the plunger 13 which protrudes from the switch housing 10.

A slider 15 is connected to the plunger 13 within the switch 1. The slider 15 is movable by means of the plunger 13, in this case by a linear pushing movement of the plunger 13, the slider 15 is movable in a plane above a circuit board 30 arranged in the switch housing 10. In the installed state of the switch 1, the plunger 13 can be actuated from the outside by means of an actuation element, the plunger 13 thereby sliding into the interior of the switch housing 10. The linear sliding movement of the plunger 13 displaces the slider 15 provided on the plunger 13.

Figure 2A:
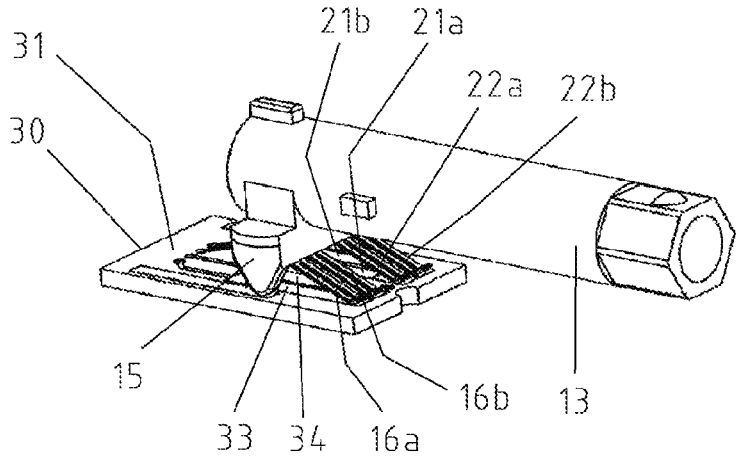
FIG. 2*a* is a sectional view of the electric switch of FIG. 1 in the off position.

In FIG. 2*a*, sliding contacts 22*a*, 22*b* of a contact system 20 as well as sliding contacts 16*a*, 16*b* for controlling rotational speed are situated on the slider 15. The sliding contacts 16*a*, 16*b* contact potentiometer tracks 33, 34 on an upper surface 31 of the circuit board 30. The sliding contacts 22*a*, 22*b* are situated in the same way on the upper surface 31 of the circuit board 30. In at least one embodiment, in an off position of the switch (shown in FIG. 2*a*), the sliding contacts 22*a*, 22*b* of the contact system 20 do not touch contact paths 21*a*, 21*b* running along the upper surface 31 of the circuit board 30, as can be seen in FIG. 2*b*.

Figure 2B:
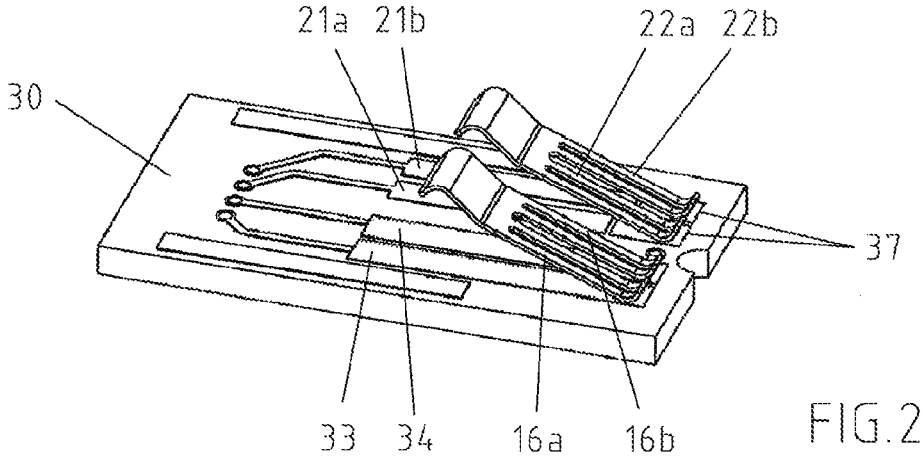
FIG. 2*b* is a perspective view of the contact system in FIG. 2*a* in the off position.

FIG. 2*b* illustrates the sliding contacts 16*a*, 16*b*, 22*a*, 22*b* without the slider 15 and the plunger 13. It is clear that the sliding contacts 22*a*, 22*b* do not touch the contact path 21*a*, 21*b* in the off position, but rest on insulating pads 37 that are arranged adjacent to the contact paths 21*a*, 21*b* on the front end the circuit board 30. The sliding contacts 16*a*, 16*b*, 22*a*, 22*b*, which are held on the slide 15, are pulled away from the front end of the circuit board 30 by the movement of the plunger 13.

Figure 2C:
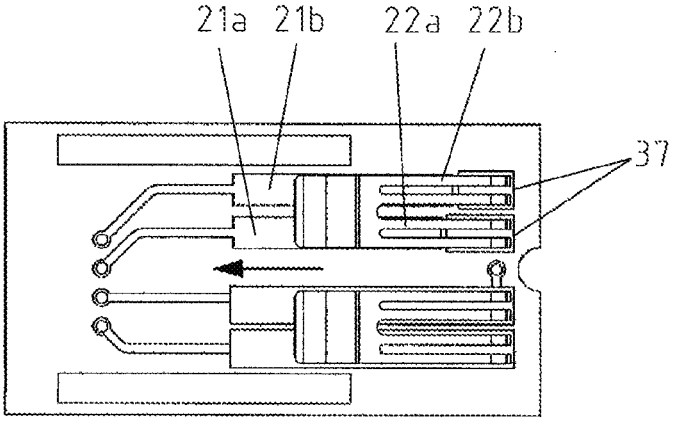
FIG. 2*c* is a top view of the contact system in FIG. 2*a* in the off position.

As showing in FIG. 2*c*, the sliding contacts 22*a*, 22*b* of the contact system are moved downward from the insulating pads 37 and, following a very short displacement path, contact the contact paths 21*a*, 21*b*, thereby switching the switch 1 and the corresponding device on. The sliding contacts 16*a*, 16*b* will already be in contact with the potentiometer tracks 33, 34. By way of a corresponding displacement movement of the plunger 13, the resistance along the potentiometer tracks 33,34 can be changed and the rotational speed appropriately adjusted. The sliding contacts 22*a*, 22*b* of the contact system remain in contact with the contact paths 21*a*, 21*b* during this displacement movement.

The contact paths 21*a*, 21*b* and the potentiometer tracks 33,34 arranged on the upper surface 31 of the circuit board 30 are provided to run in the same direction. The contact paths 21*a*,21*b* are at least as long as the longest possible displacement path of the sliding contacts 16*a*,16*b*, that is, together with the potentiometer tracks 33,34.

Figure 3A:
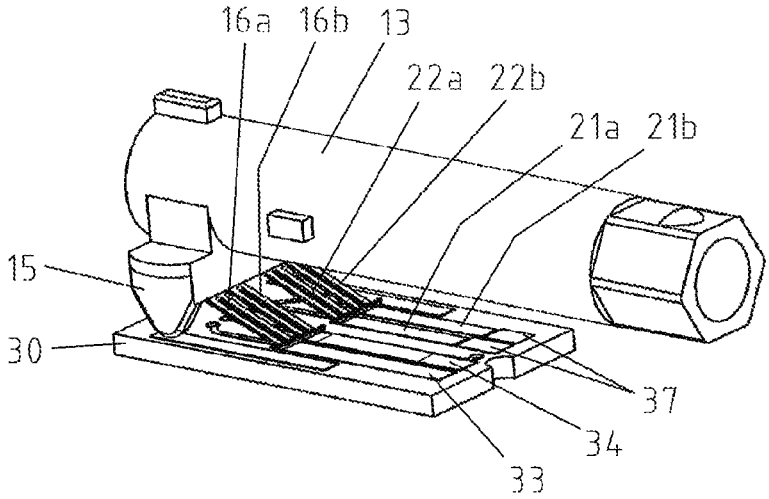
FIG. 3*a* is a sectional view of the electric switch of FIG. 1 in the on position.
Figure 3B:
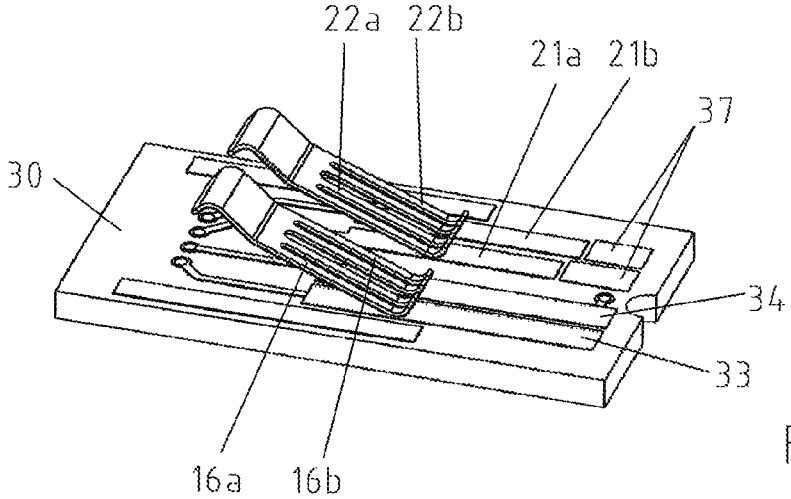
FIG. 3*b* is a perspective view of the contact system in FIG. 3*a* in the on position.
Figure 3C:
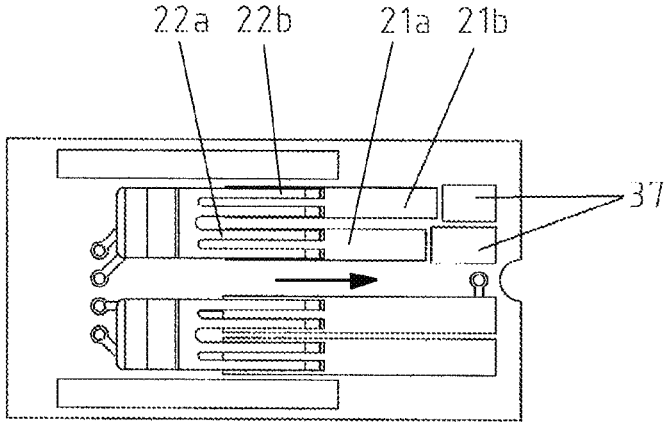
FIG. 3*c* is a top view of the contact system in FIG. 3*a* in the on position.

FIGS. 3*a*, 3*b*, 3*c* show the electric switch in the on position. All of the sliding contacts 16*a*, 16*b*, 22*a*, 22*b* are located on contact pads, namely on the potentiometer tracks 33, 34 or the contact paths 21*a*, 21*b* of the contact system 20. It is clear from these views that the insulating pads 37 on the front end of the circuit board 30 are provided as an extension of the contact path 21*a*, 21*b*. Prevention of contact may also be provided by using a means other than the insulating pads 37. As shown by the arrow in FIG. 3*c*, the movement back to the off position from the on position is effected by a return spring 60 as soon as no pressure is applied to the plunger 13 by way of the actuation element (not shown).

The ends of the sliding contacts 22*a*, 22*b*, 16*a*, 16*b* in this example are U-shaped and are situated via spring on the corresponding contact pads of the contact paths 21*a*, 21*b* or the potentiometer tracks 33, 34. The chosen form of sliding contacts 16*a*, 16*b*, 22*a*, 22*b* will provide for sufficient contact pressure.

The above embodiments are merely to illustrate the technical solutions of the present invention and are not intended to limit the present invention. Although the present invention has been described with reference to the above preferred embodiments, it should be appreciated by those skilled in the art that various modifications and variations may be made without departing from the spirit and scope of the present invention.

The invention claimed is:

1. An electric switch applied in an electric appliance having an electric motor, the electric switch comprising:

a circuit board located in a switch housing of the electric switch, a switch path and a potentiometer track arranged on same surface of the circuit board;

a first sliding contact configured to contact the switch path to switch a contact system; and a second sliding contact configured to contact the potentiometer track for setting the rotational speed and/or the torque of the electric motor;

wherein the first sliding contact and the second sliding contact are moving in synchronism.

2. An electric switch applied in an electric appliance having an electric motor, the electric switch comprising:

a circuit board located in a switch housing of the electric switch, a switch path and a potentiometer track arranged on same surface of the circuit board;

a first sliding contact configured to contact the switch path to switch a contact system; and a second sliding contact configured to contact the potentiometer track for setting the rotational speed and/or the torque of the electric motor;

wherein the first sliding contact and the second sliding contact are moving in synchronism, the switch path and the potentiometer track placed on same surface of the circuit board are functioned differently and actuated by same way.

3. The electric switch of claim 2, wherein the switch path is at least as long as a longest possible displacement path of the second sliding contact.

4. The electric switch of claim 2, wherein an insulating pad is arranged adjacent to the switch path on the front end the circuit board and is provided as an extension of the switch path; wherein when the first sliding contact contacts the switch path, the contact system is in an on position, wherein when the first sliding contact contacts the insulating pad, the contact system is in an off position.

5. The electric switch of claim 2, wherein the switch path and the potentiometer track are arranged on one of surfaces of the circuit board and are extended in same direction.

6. The electric switch of claim 4, wherein the first sliding contact and the second sliding contact are disposed on a slider which connected to a plunger in the switch housing, the slider is being linear sliding movement in a plane above the circuit board by the plunger.

7. The electric switch of claim 6, wherein the plunger is protruded from the switch housing and is manually actuated from the outside by an actuation element.

8. The electric switch of claim 7, wherein the switch housing of the electric switch comprises an upper shell and a lower shell, the upper shell and the lower shell is connected together via a clamping connection.

9. The electric switch of claim 8, wherein a one-piece circumferential seal is provided between the upper shell and the lower shell of the switch housing, and the seal being formed into a ring in the area of an opening of the switch housing, the plunger is protruded from the switch housing through the opening.

10. The electric switch of claim 6, wherein a return spring is arranged to contact the plunger, the movement back to the off position from the on position is effected by the return spring when no pressure is applied to the plunger by way of the actuation element.

11. The electric switch of claim 2, wherein ends of the first sliding contact and the second sliding contact are U-shaped and are situated via spring force on the corresponding switch path or the potentiometer track.

12. The electric switch of claim 2, wherein a changeover device is provided for the purpose of changing the direction of the electric motor, the changeover device interacting with conducting paths on the surface of the circuit board.

13. The electric switch of claim 2, wherein an insulating pad is arranged adjacent to the switch path on the front end the circuit board and is provided as an extension of the switch path; wherein when the first sliding contact contacts the switch path, the contact system is in an on position, wherein when the first sliding contact contacts the insulating pad, the contact system is in an off position.

14. An electric switch applied in an electric appliance having an electric motor, the electric switch comprising:

a plunger protruding from a switch housing and connected to an actuation element, a movement of the plunger configured to switch a contact system from an off position into an on position, the contact system being arranged within the switch housing and comprising a first sliding contact and corresponding switch path, the first sliding contact of the contact system arranged on the plunger within the switch housing on one side of the plunger as well as a second sliding contact, wherein the first and second sliding contacts are jointly movable by way of actuation of the plunger, a circuit board immovably arranged in the switch housing, wherein the switch path of the contact system and contact surfaces in a form of potentiometer track are arranged on one same surface of the circuit board;

wherein a rotational speed or a torque of the electric motor is adjustable through interaction between the second sliding contact and the potentiometer track on the circuit board; and wherein in the on position, the first sliding contact of the contact system and the second sliding contact are in a same way contacted the associated switch path and the associated potentiometer tracks respectively, and switching the contact system from an off position into an on position and adjusting rotational speed or torque of the electric motor are both actuated by the movement of the plunger.

15. The electric switch of claim 14, wherein the switch path is at least as long as a longest possible displacement path of the second sliding contact.

16. The electric switch of claim 14, wherein an insulating pad is arranged adjacent to the switch path on the front end the circuit board and is provided as an extension of the switch path; wherein when the first sliding contact contacts the switch path, the contact system is in the on position, wherein when the first sliding contact contacts the insulating pad, the contact system is in the off position.

17. The electric switch of claim 14, wherein a return spring is arranged to contact the plunger, the movement back to the off position from the on position is effected by the return spring when no pressure is applied to the plunger by way of the actuation element.

18. The electric switch of claim 14, wherein ends of the first sliding contact and the second sliding contact are U-shaped and are situated via spring force on the corresponding switch path or the potentiometer track.

19. The electric switch of claim 14, wherein a changeover device is provided for the purpose of changing the direction of the electric motor, the changeover device interacting with conducting paths on the surface of the circuit board.

* * * * *